US006610148B2

(12) United States Patent
Ruschak et al.

(10) Patent No.: US 6,610,148 B2
(45) Date of Patent: Aug. 26, 2003

(54) CURTAIN COATING STARTUP APPARATUS

(75) Inventors: Kenneth J. Ruschak, Rochester, NY (US); Robert J. Deprez, Avon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/994,167

(22) Filed: Nov. 26, 2001

(65) Prior Publication Data

US 2003/0097980 A1 May 29, 2003

(51) Int. Cl.[7] ..... B05B 1/28

(52) U.S. Cl. ..... 118/326; 118/300; 118/324; 118/325; 118/DIG. 4; 427/420

(58) Field of Search ..... 118/300, 324, 118/325, 326, DIG. 4; 427/420

(56) References Cited

U.S. PATENT DOCUMENTS

| | | | | |
|---|---|---|---|---|
| 3,508,947 A | | 4/1970 | Hughes | |
| 4,851,268 A | | 7/1989 | Kozak | |
| 5,017,408 A | | 5/1991 | Kozak | |
| 5,328,726 A | | 7/1994 | Reiter | |
| 5,725,910 A | | 3/1998 | Devine et al. | |
| 5,763,013 A | | 6/1998 | Devine et al. | |
| 5,773,093 A | * | 6/1998 | Mitani et al. | 427/420 |
| 5,885,659 A | | 3/1999 | Takahashi et al. | |
| 5,976,251 A | | 11/1999 | Devine, III et al. | |
| 6,294,023 B1 | * | 9/2001 | Katagiri et al. | 118/410 |
| 6,387,455 B1 | * | 5/2002 | Katagiri et al. | 427/420 |

FOREIGN PATENT DOCUMENTS

| | | |
|---|---|---|
| EP | 0563308 B1 | 5/1995 |

* cited by examiner

*Primary Examiner*—Richard Crispino
*Assistant Examiner*—Michelle A Lazor
(74) *Attorney, Agent, or Firm*—Mark G. Bocchetti

(57) ABSTRACT

A catch pan apparatus for starting and stopping coating is disclosed for coating a downwardly moving receiving surface by curtain coating. The catch pan device includes an intercepting pan that intercepts the curtain when coating is stopped and a substantially horizontal intercepting surface that intercepts the curtain only when the catch pan moves to start or stop coating. The intercepting pan and horizontal intercepting surface intersect to create a volume that retains in the catch pan excess liquids that would otherwise spill onto the coating receiving surface as the catch pan is retracted to a non-intercepting position. The catch pan is controllably retracted at high speed through the curtain using linear servomotors such that the releasing edge of the horizontal intercepting surface passes close to the coating receiving surface at the point of curtain release. Flushed edge guides maintaining curtain width are positioned outside the lateral edges of the catch pan. The lateral edges of the intercepting pan have side walls that intercept edge portions of the curtain. The side walls project outward and upward and terminate with horizontal severing edges spaced closely to the edge guides. Edge portions of the curtain are thereby directed partly onto the intercepting pan and partly onto the edge guides for evacuation by the edge guide suction removal means.

15 Claims, 6 Drawing Sheets

CURTAIN COATING STARTUP APPARATUS

FIELD OF THE INVENTION

The present invention relates generally to methods and apparatus for coating objects or moving webs by curtain coating and, more particularly, to an improved curtain coating method and apparatus for the manufacture of sheet goods including films and papers.

BACKGROUND OF THE INVENTION

In curtain coating, a moving receiving surface is coated by the impingement of a free-falling curtain of liquid coating composition. The curtain may be a single coating composition or a composite of a plurality of layers of distinct coating compositions such as is described in U.S. Pat. No. 3,508,947 to Hughes. The coating receiving surface can be any surface that can be passed through a curtain. The receiving surface may be a continuous web of paper, plastic, metal, or cloth. In applications demanding high coating uniformity, such as the coating of photographic films and papers, the web must be stabilized by a precision backing roller to prevent vibrations of the tensioned web.

It is desirable to start and stop coating without the deposition of excess coating liquids on the coating receiving surface. Excess liquids necessitate additional dryer capacity and, therefore, result in additional costs. Coating composition that does not dry can result in contamination of the coating machine and cause laps in wound rolls of coated web to adhere to one another.

A method and apparatus for making starts and stops in curtain coating with minimal excess coating liquids on the receiving surface is described in U.S. Pat. No. 4,851,268 to Kozak. The startup of the curtain coating process is achieved by using a downwardly inclined catch pan device closely spaced to the backing roller and positioned to intercept the falling curtain before and during retraction of the pan. As shown in FIG. 1, the prior art catch pan 10 has two spaced lips on its trailing end, a primary lip 12 that retains the curtain liquid puddle formed on the device during coating startup and a secondary lip 14. There is a pan extension area 16 between the two lips 12, 14 that captures the curtain liquids extended from their free fall position as the primary lip 12 intercepts the curtain during its retraction. Preferably, the height of the two lips 12, 14 and the distance between them is determined by the retraction speed of the catch pan 10 and the time it takes the curtain to fall the distance from the top of the primary lip 12 to the pan extension area 16. The method requires passing the catch pan 10 through the curtain at high speed (50 to 200 centimeters per second) in the direction of the moving web. A disadvantage of this catch pan 10 is the risk of collision with the coating receiving surface because there is only a small gap therebetween. Another disadvantage is that it is possible for the catch pan 10 to outrun the curtain. That is, the curtain fails to contact the pan extension area 16 and secondary lip 14 because the vertical distance between the primary lip 12 and secondary lip 14 over which the curtain drops is too great.

In U.S. Pat. No. 5,017,408 to Kozak, a catch pan side wall geometry is disclosed that prevents excess liquids from being deposited on the edges of the coating receiving surface when starting or stopping. As shown in FIGS. 2 and 3, the sidewalls 18 of the catch pan 20 have flexible extensions 22 that make contact with the flushed edge guides 24 maintaining the curtain width. This contact removes the flushing liquid stabilizing the edges of the curtain 26. The curtain 26 may reform slowly or not at all on the dried portion of the edge guides 24 when the catch pan 20 is retracted. The edge guides 24 can also be contaminated or damaged by contact and their function impaired. The flexible edges 22 of the catch pan 20 may curl up when coating composition dries on them such that contact with the edge guides 24 is lost and excess coating solution passes onto the receiving surface 28 through the gap thereby created.

In U.S. Pat. No. 5,885,659 to Takahashi et al., a catch pan 30 as shown in FIG. 4 for use on a uniformly inclined upwardly running web 32 is disclosed wherein the pan 30 is retracted in the direction opposite to web motion. A receiving portion 34 of the pan 30 receives the curtain 36 before coating. A shelf portion 38 of the pan 30 receives the curtain 36 as the pan 30 is withdrawn to start coating. The shelf portion 38 and receiving portion 34 of the pan 30 are connected by an upright wall 40 of at least 8 millimeters that cuts the curtain 36 as the pan 30 is withdrawn and isolates the liquid in the receiving portion 34 of the pan 30. The shelf portion 38 is upwardly inclined from the receiving portion 34 by at least 5 degrees from horizontal to recover the liquid intercepted by the shelf portion 38. A disadvantage of this method is that the upright wall (level difference) 40 may have to exceed substantially 8 millimeters because of the tendency of the pooled liquids in the receiving portion 34 of the pan 30 to climb and spill over the upright wall 40 as the pan 30 retracts. The higher level difference necessitates a longer shelf 38. Also, retracting the catch pan 30 in the direction opposite to web motion causes any excess liquids that may reach the web 32 to pass through the curtain 36 and thereby disturb it. An additional disadvantage is that coating application must be performed on an unsupported web 32 under tension. This is generally not suitable for the most demanding applications.

The prior art catch pans are directed to coating receiving surfaces that are horizontal or slightly inclined. In European Patent Specification No. 0563308 B1 to Blake and Ruschak, a curtain coating method is disclosed in which the coating receiving surface is significantly downwardly inclined. Coating speed, as well as latitude in viscosity and coating thickness can frequently be increased by this method, and there is a need for a catch pan for a downwardly inclined coating receiving surface.

Typically, prior art catch pan systems include pneumatic cylinders positioned on each side of the catch pan. The pneumatic cylinders are used to drive the catch pan into and out of a curtain intercepting position. Pneumatic cylinders allow for a pan velocity on the order of 60 to 130 centimeters per second at the point the catch pan releases the curtain. The catch pan travels a distance on the order of about 20 cm through actuation of the pneumatic cylinders. The travel length and velocity require acceleration rates on the order of 2 times gravitational acceleration. Accelerating both sides of the catch pan at the same rate in order to maintain alignment using pneumatic cylinders is problematic at best. Prior art catch systems using pneumatic cylinders must be designed to allow for some undesirable skewing of the catch pan as it is accelerated into and out of the intercepting position.

The typical configuration of curtain coating apparatus often makes it impractical to tie the sides of the catch pan together rigidly enough to maintain alignment due to weight and the required acceleration rates. Further, mechanical linking mechanisms for tying the two pneumatic cylinders and therefore, the sides of the catch pan together are prone to misalignment, backlash, deflection, and wear. Attempts have been made to control the alignment of the catch pan while driving it with pneumatic cylinders by using equal lengths of supply and exhaust tubing for each cylinder as well as using precision pressure and flow control valves. However, even using these types of measures, the misalignment of the catch pan during movement is still on the order of several millimeters. Further, the speed achieved using pneumatic cylinders is inconsistent from cycle to cycle varying by 10% or more. The alignment and speed control of these prior art pneumatically driven systems is affected by friction from mechanical components and seals, deterioration of valves and controls, as well as dirt and wear.

It should also be understood that there is no controlled deceleration of the catch pan using pneumatic cylinders. Rather, the length of travel is limited in each direction by shock absorbing travel stops. The hard stops can ultimately result in damage to the catch pan and/or the travel mechanism. Further, the vibrations generated by the hard stops can have a deleterious effect on the coating operation.

SUMMARY OF THE INVENTION

It is therefore an object of the present invention to provide a catch pan for downwardly inclined coating receiving surfaces that is free of the limitations and disadvantages of prior art.

It is a further object of the present invention to provide a catch pan that does not deposit excess liquids on the receiving surface.

Yet another object of the present invention is to provide a catch pan that cannot be outrun by high retraction speeds.

Still another object of the present invention is to provide a catch pan that retracts in the direction of motion of the coating receiving surface and that permits the use of a backing roller at the point of coating application.

A further object of the present invention is to provide a catch pan that has a reduced risk of collision with the coating receiving surface.

Yet another object of the present invention is to provide a catch pan that intercepts the edge portions of the curtain without contacting the edge guides.

Briefly stated, the foregoing and numerous other features, objects and advantages of the present invention will become readily apparent upon a review of the detailed description, claims and drawings set forth herein. These features, objects, and advantages are accomplished by providing a catch pan that includes an intercepting pan segment that intercepts the curtain when coating is stopped, a substantially horizontal intercepting surface extending from the intercepting pan segment that intercepts the curtain when the catch pan is in motion, a release edge of the horizontal intercepting surface that passes close to the coating receiving surface at the point of curtain release, and two synchronized servo motors that drive the catch pan at high speed without lateral skewing. The horizontal intercepting surface overhangs the intercepting pan segment to form a capture chamber that has a volume of at least 1 cubic centimeter per centimeter of coating width in order to prevent excess coating solution in the intercepting pan from spilling onto the coating receiving surface. The bottom of the catch pan does not have to be closely spaced to the coating receiving surface. Rather, the small gap can be limited to the point of release of the curtain. Preferably, the speed of the catch pan as it is moved into and out of a curtain intercepting position, is at least about 100 cm/s and the releasing edge of the catch pan passes to within a distance of about 2 cm of said coating receiving surface at the point the curtain is released to impinge upon the surface of the substrate being coated.

Wire edge guides with suction removal means are also provided. The sidewalls of the intercepting pan segment have wing elements extending outward and upward toward the edge guides and terminating in a substantially horizontal severing edge gapped closely to the edge guides. Coating composition passing through the gap between the severing edge and the edge guide is drawn to the edge guide by surface tension and removed by the suction means so that the coating receiving surface remains dry until the catch pan is retracted. In addition to obviating the lateral skewing problem associated with driving mechanisms used to drive prior art pans, the two synchronized servo motors allow for controlled acceleration and deceleration of the catch pan in a non-violent manner.

DETAILED DESCRIPTION OF THE INVENTION

Figure 5:
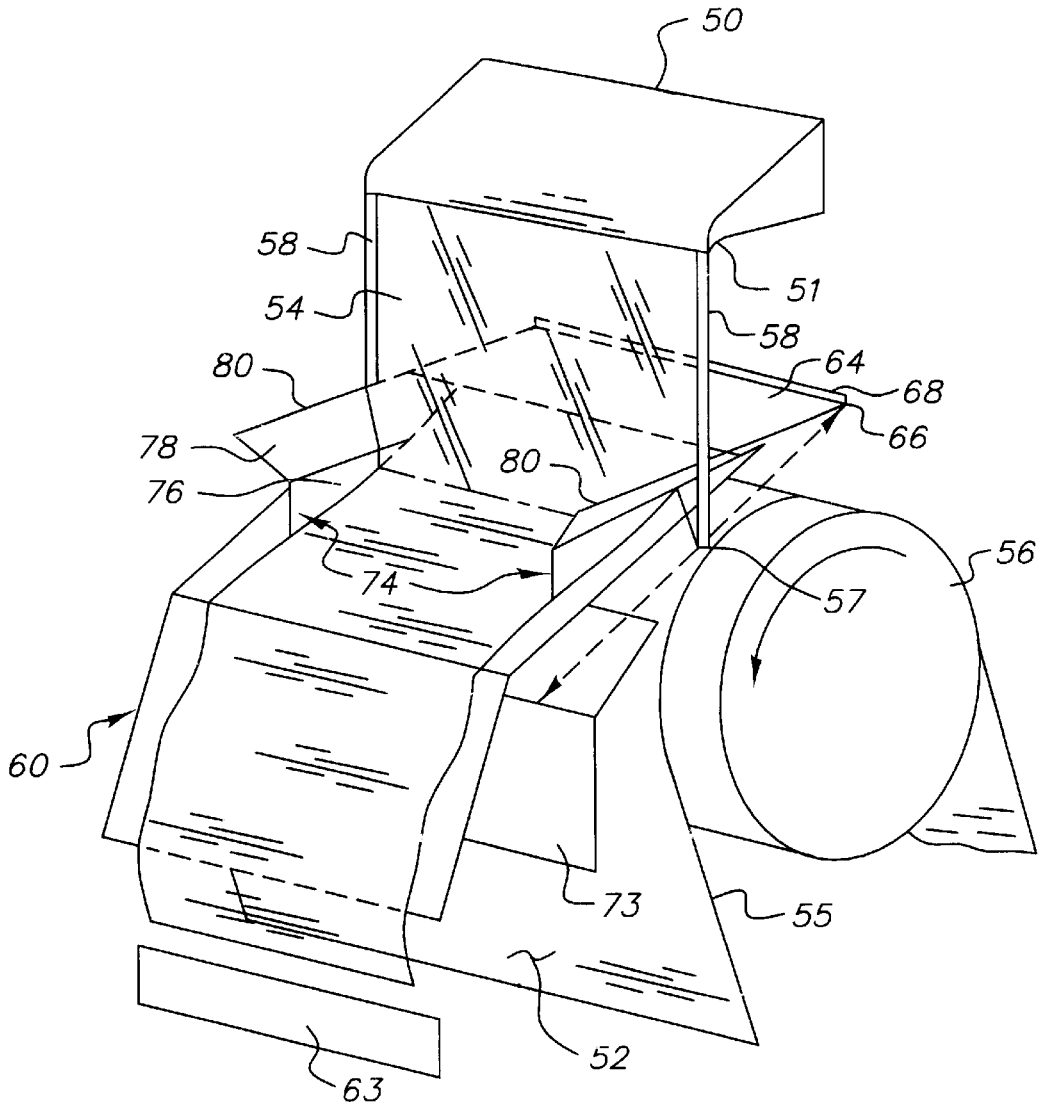
FIG. 5 is a perspective view of the catch pan of the present invention positioned in an intercepting position over a backing roller supporting a moving web.
Figure 8:
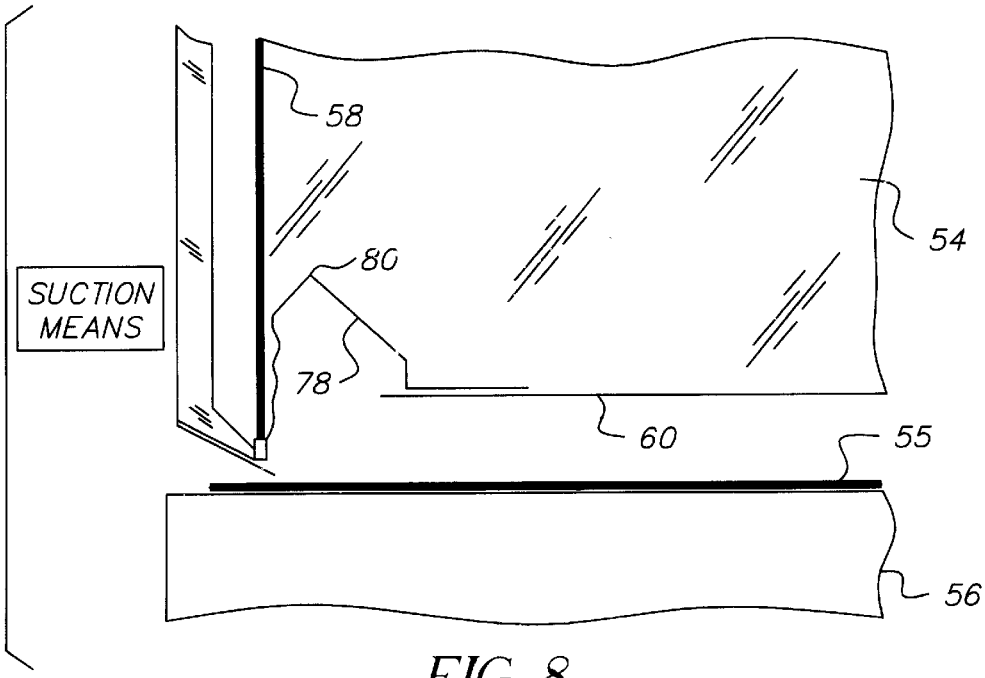
FIG. 8 is a partial front elevational view of the catch pan shown in FIG. 5 intercepting a curtain with a shielding surface provided over the web and below the catch pan.

Curtain-forming apparatus 50 for forming free-falling liquid curtains are well known in the art. Dies or weirs may be used for example. A curtain that is a composite of several layers of distinct coating compositions can be formed by a slide die with multiple elements for distributing coating compositions. In all cases, the coating composition falls from a horizontal lip 51 of curtain-forming apparatus 50 to the coating receiving surface 52 over a vertical distance between about 2 cm and about 30 cm. The coating composition in curtain 54 is freely falling and accelerates by gravity. The coating receiving surface 52 can be any surface that can be passed through the curtain 54 such as discrete three-dimensional objects or continuous webs. As depicted in FIG. 5, a web or substrate 55 including coating receiving surface 52 is preferably supported at the point 57 (or more accurately, a line) of curtain impingement by a precision backing roller 56. The moving substrate is moving downward at an angle between about 20° and about 60° from horizontal at a point where the free-falling curtain impinges thereon. The lateral edges of the free-falling curtain 54 are usually supported by two edge guides 58 (see FIG. 8) which are vertically arranged and act to maintain the horizontal width of the free-falling curtain 54 between the curtain-forming apparatus 50 and the coating receiving surface 52. Although many edge guides are known in the art, wire edge guides with suction removal means as disclosed in U.S. Pat. No. 5,328,726 to Reiter, and in U.S. Pat. Nos. 5,725,910, 5,763,013, and 5,976,251 to Devine et al. are particularly advantageous for use with the catch pan 60 of the present invention. Most often, edge guides 58 are flushed with a solvent for the coating composition to prevent the buildup of dried or congealed coating composition and to reduce the drag of the edge guides 58 on the free-falling curtain 54. An example of a flushing solvent suitable for water-based coating compositions is water.

Figure 1:
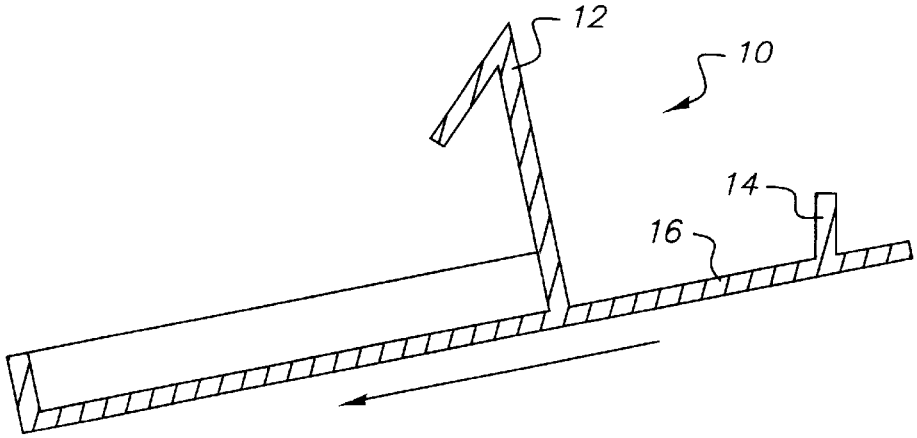
FIG. 1 (PRIOR ART)
FIG. 1 is a cross-sectional side elevational view of a prior art catch pan having primary and secondary lips separated by a pan extension.
Figure 2:
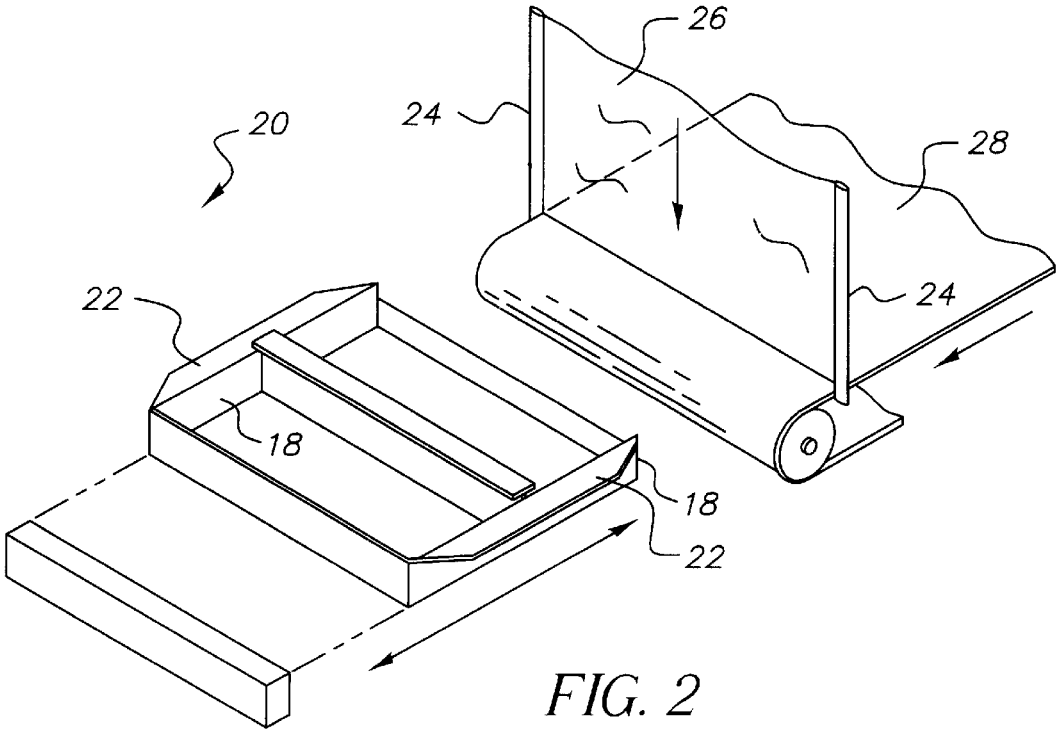
FIG. 2 (PRIOR ART)
FIG. 2 is a perspective view of a prior art catch pan retracted to a non-intercepting position relative to a free-falling curtain coating onto a moving web.
Figure 3:
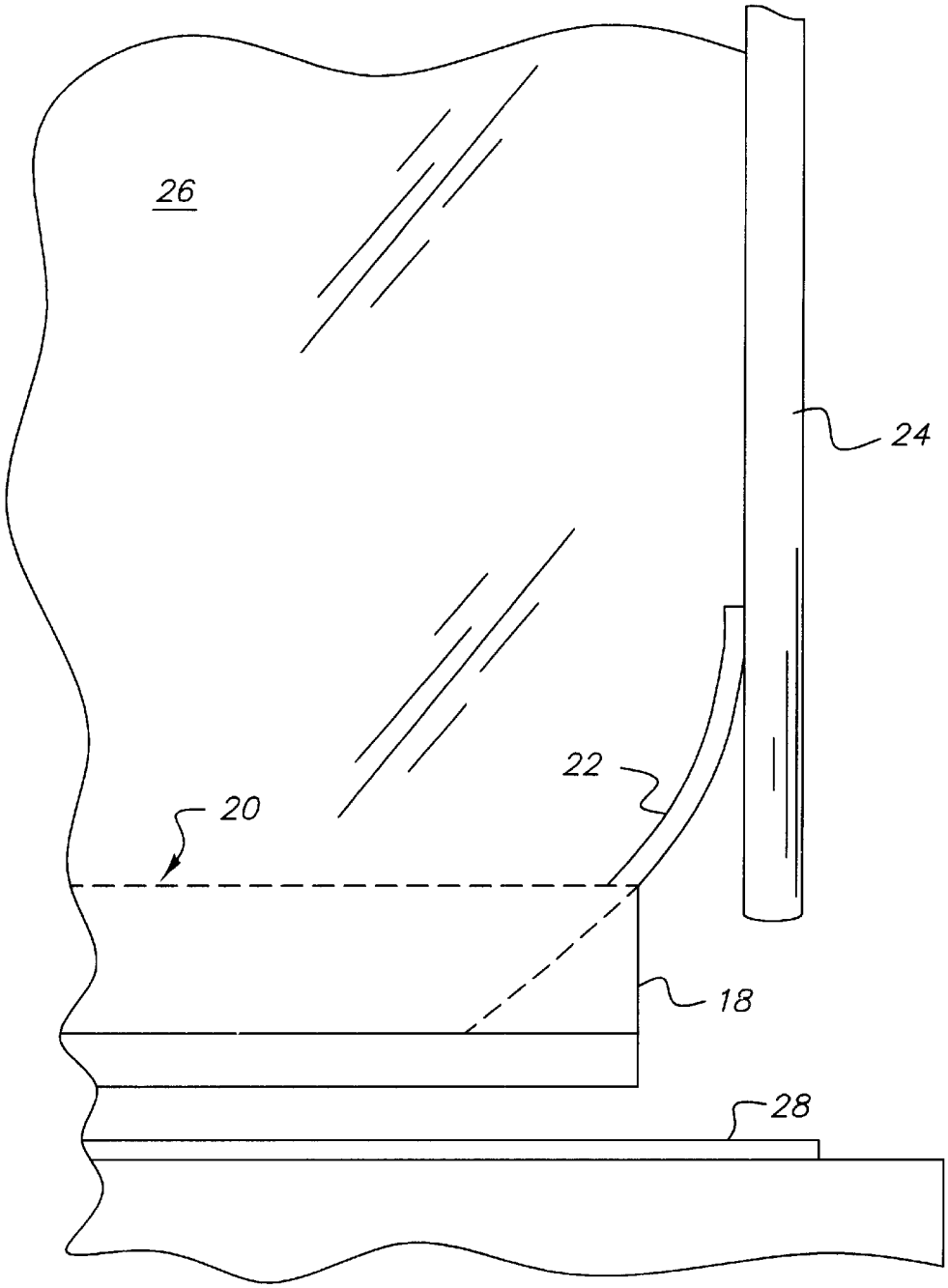
FIG. 3 (PRIOR ART)
FIG. 3 is a partial front elevational view of the catch pan and free-falling curtain depicted in FIG. 2 showing the flexible lateral edges of the catch pan engaging the edge guides of the coating apparatus.
Figure 4:
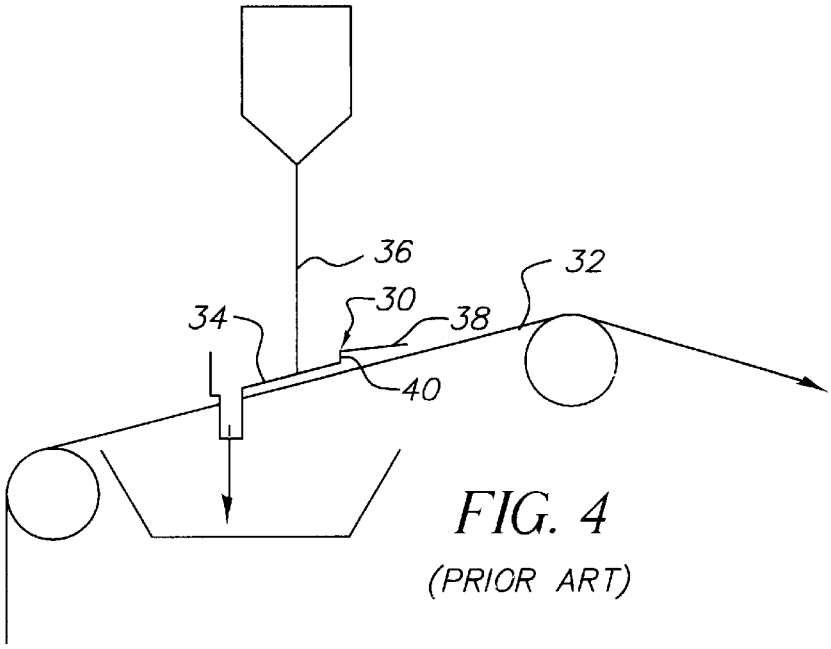
FIG. 4 (PRIOR ART)
FIG. 4 shows a side view schematic of a prior-art catch pan in combination with a curtain forming apparatus that includes a die for forming a free-falling curtain, a sink below the catch pan, and a coating receiving surface that is a uniformly inclined upwardly running web.
Figure 6:
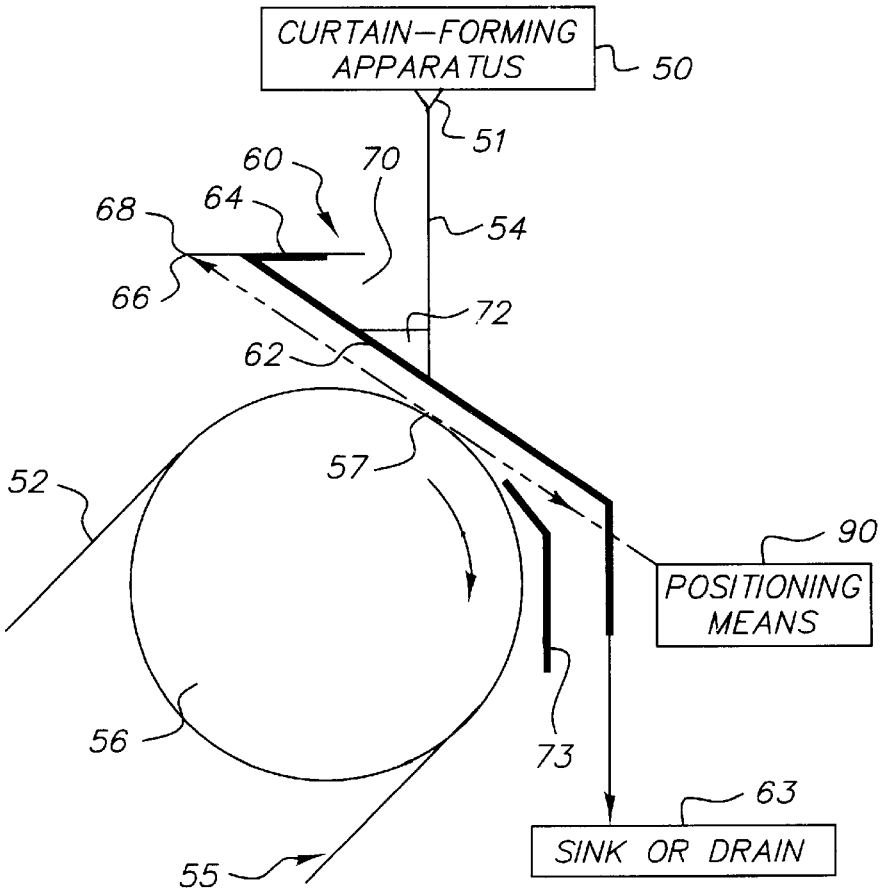
FIG. 6 is a side elevational schematic of the catch pan system of the present invention with the catch pan residing in an intercepting position.

The curtain 54 is intercepted by intercepting pan segment 62 of the catch pan 60 when coating is stopped. The intercepting pan segment 62 does not have to be in very close proximity to the coating receiving surface 52 and can be spaced away by a centimeter or more. The intercepting pan segment 62 may be connected to a drain (not shown) through a flexible conduit (not shown), but it can preferably be configured to direct the coating composition into sink or drain 63, as shown in FIG. 6. The term "drain" as used herein is, however, intended to include any disposal or recycle system such as, for example, sinks, drain conduits, sewer lines, and piping to holding tanks. The intercepting pan segment 62 may be made of sheet material that has been formed or molded and its surfaces may be coated to facilitate cleaning. The sheet material may be contoured for improved rigidity as by stamping, but any such contouring should encourage drainage and not produce pooling and splattering. The sheet material can also be structured for rigidity by bending and by configuring large cross sections that are hollow or filled with low density material. It is preferred that the weight of the intercepting pan segment 62 be minimized to facilitate handling and positioning.

Attached to intercepting pan segment 62 is a substantially horizontal intercepting surface 64 that intercepts the curtain 54 when the catch pan 60 is moving. The horizontal intercepting surface 64 has a release edge 66 that is parallel to the curtain 54 and preferably resides in a horizontal plane. The curtain 54 is released onto the coating receiving surface 52 when pan 60 is moved out of an intercepting position. A lip 68 of about 2 millimeters in height may be included to project vertically from intercepting surface 64 at or near release edge 66. The horizontal intercepting surface 64 moves so rapidly that the coating composition does not pool thereon. Optional lip 68 can prevent any small excess of coating composition from spilling onto the coating receiving surface 52. The tendency for pooling on the horizontal intercepting surface 64 diminishes as the speed of the catch pan 60 increases. So, it is advantageous to retract the catch pan 60 at the highest possible controlled speed.

Horizontal intercepting surface 64 extends over a portion of intercepting pan segment 62 to form a capturing chamber or volume 70 above intercepting pan segment 62 and below intercepting surface 64. The capturing chamber or volume 70 should be at least 1 cubic centimeter per centimeter of curtain width. When the intercepting pan 60 is stationary, coating composition forms a pool 72 on intercepting pan segment 62 proximate to where the curtain 54 impinges on the intercepting pan segment 62. This pool 72 of liquid is captured by capturing chamber or volume 70 as the catch pan 60 retracts toward a non-intercepting position. The pool 72 of liquid is thereby prevented from spilling onto the coating receiving surface 52. It should be noted that intercepting pan segment 62 is angled to continuously drain to sink 63 and therefore, capturing chamber or volume 70 continuously drains to sink 63 as well.

The curtain-release edge 66 of horizontal intercepting surface 64 is close to coating receiving surface 52 at the point of curtain release to minimize the transfer of excess coating composition. Mechanical contact between the catch pan 60 and the receiving surface 52 is, however, undesirable. With the catch pan 60 positioned such that release edge 66 is in the plane of the curtain 54, the distance between the release edge 66 and the coating receiving surface 52 is less than about 2 centimeters and a distance of 1 millimeter is achievable with well constructed pans.

Figure 7:
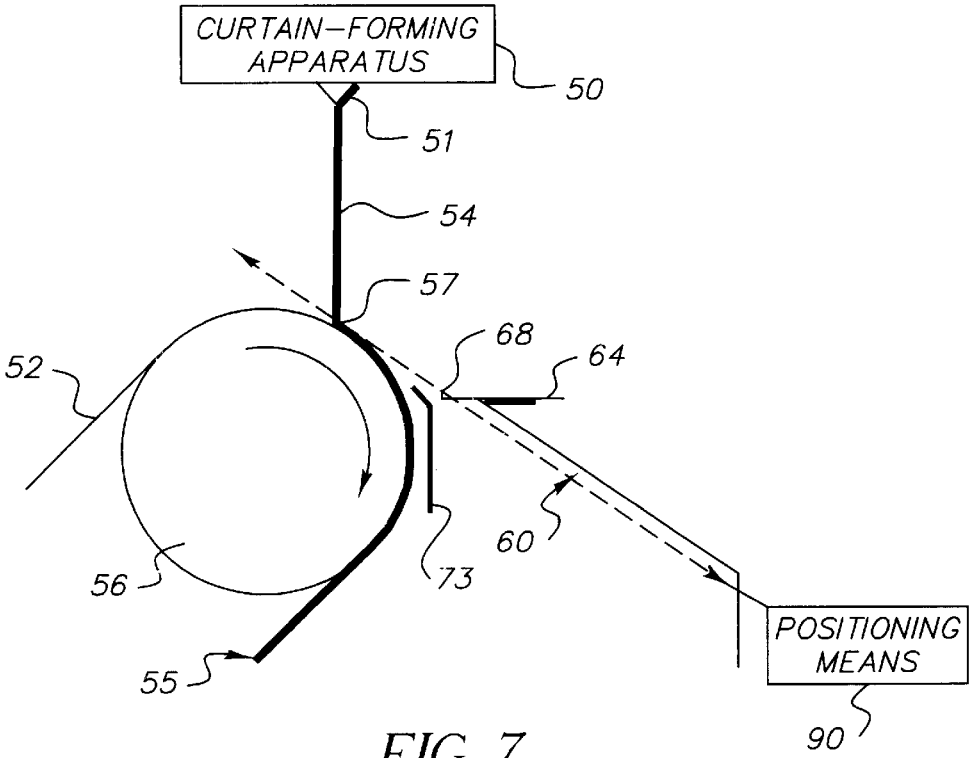
FIG. 7 is a side elevational schematic of the catch pan system of the present invention with the catch pan residing in a non-intercepting position.

Video recordings of starts at 1000 frames per second show that the curtain is not severed as it passes the release edge. Rather, it clings to the receding release edge by surface tension and the curtain is bent. When the curtain contacts the web, it still extends to the release edge of the catch pan. There is an accumulation of liquid between the release edge and the web in this extension of the curtain. Particularly at low coating speeds, this excess liquid may ultimately be released and drawn onto the web at the start line by surface tension. Particularly at high coating speeds, this extension of the curtain may disintegrate into droplets that fall to the sink as the release edge and start line separate. The deposition of any of this excess liquid on the web is not desirable. The problem becomes more severe as the gap between the release edge of the pan and the web is increased because the curtain takes more time to fall to the receiving surface and so more liquid accumulates. It has been found that a shielding surface 73 over the web (see FIGS. 5–7) and below the catch pan can capture much of this excess liquid and improve coating starts, thereby mitigating the effect of a larger gap.

EXAMPLE 1

Curtain coating starts were made in accord with the invention under the following conditions: curtain height, 27 cm, inclination of the web at the point of curtain impingement, 20 degrees downward from horizontal, web, polyethylene terepthalate with a thin subbing of gelatin. The coating composition was 12.3% aqueous gelatin containing surfactant and a dispersion of black pigment to provide optical density. The viscosity of the coating composition was about 40 centipoise. The start pan was observed using high speed video at 1000 frames per second.

The horizontal intercepting surface defined a capturing volume of 1.4 cc per cm of width. High speed video verified that this capturing volume was adequate to capture all excess liquid in the intercepting pan. The release edge of the horizontal intercepting surface was gapped from the web at 1.5 mm at the position of the curtain.

The region of the start line was imaged to obtain optical density which is directly proportional to coating thickness. In this way, the excess liquid at the start of coating was measured. Excess liquid is defined as that above the value that is intended and is obtained by integration from the optical density measurements. The measurement of excess liquid quantifies the performance of the catch pan. However, the practical consequences of this excess liquid usually depends on whether it is spatially concentrated or diffuse. The ultimate distribution of the excess liquid depends upon many specifics of the coating operation because the excess liquid flows by surface tension and gravity until immobilized in the dryer. The factors affecting flow include the viscosity of the coating composition, the absorbency of the receiving surface, the distance between the coating station and the dryers, the volatility of the solvents, and the settings of the dryer.

Starts were made at a flow rate of 3 cc/sec per cm of width and a coating speed of 250 cm/sec. In one case, the horizontal intercepting surface was flat and in a second case, a vertical lip 3 mm in height was present at the release edge. At a catch pan speed of 200 cm/sec, the flat geometry produced an excess at the start line of 0.00046 cc per cm of width and the lipped geometry 0.0012 cc per cm of width. Under these conditions, there is no excess liquid on the horizontal intercepting surface for the lipped geometry to retain and the increased vertical drop is detrimental to the start. At a catch pan speed of 100 cm/sec, however, the flat geometry produced an excess of 0.0042 cc per cm of width and the lipped geometry 0.0025 cc per cm of width. At this lower catch pan speed, there is an excess of liquid on the horizontal intercepting surface at the point of curtain release and the lipped horizontal intercepting surface has a net benefit. Nevertheless, the best result is obtained with the flat geometry at a sufficiently high pan speed.

For the case of a pan speed of 200 cm/sec and the lipped geometry, the gap of the release edge to the web was increased from 1.5 to 10 mm. The excess coating composition at the start of coating increased from 0.0012 to 0.0041 cc per cm of width. The smallest possible gap without mechanical contact is preferred.

Starts were also made at a higher flow rate of 5 cc/sec per cm of width and a speed of 500 cm/sec. At a catch pan speed of 200 cm/sec, the flat geometry produced an excess of 0.0016 cc per cm of width. A vertical lip 2.3 mm in height at the release edge reduced the excess to 0.00045 cc per cm of width. The lipped geometry is beneficial at high flow rates when pan speed cannot be increased to compensate, as when the limits of the motor have been reached.

In many applications, it is desirable that a web receiving surface 52 be narrower than the backing roller 56 and that the coating generated by curtain 54 be narrower than the web receiving surface 52. In simultaneous multilayer coatings where the curtain 54 is a composite layer of a plurality of distinct coating compositions, reducing the edge portions of the curtain 54 that are not coated to a minimum is desirable because the collection and recycling of edge portions of the curtain 54 is not practical. In this situation, the catch pan 60 must fit between the edge guides 58. To accomplish this, intercepting pan segment 62 includes a pair of sidewalls 74, respectively positioned proximate to each side of intercepting pan segment 62. Each side wall 74 includes a vertical wall member 76 projecting in a generally vertical plane from intercepting pan segment 62 and an inclined wall member 78 extending outward and upward from the top of each vertical wall member 76 toward a respective edge guide 58. Each inclined wall member 78 terminates in a substantially horizontal severing edge 80 gapped closely to a respective edge guide 58. The angle of inclination from horizontal of inclined wall members 78 at the severing edge is preferably in the range of from about 20° to about 45° and is most preferably about 30°. The thickness of the inclined wall member 78 at the severing edge 80 should be about 1 mm or less. Each severing edge is substantially perpendicular to the free-falling curtain and resides at or below the elevation of the horizontal intercepting member. It is undesirable for coating composition to flow on the underside of the inclined wall member 78. The severing edge and the inclination of the surface near that edge is of more importance than the exact shape of the side wall. Severing edge 80 is spaced within about 1 centimeter of edge guides 58. The edge portion of the curtain 54 within that gap is drawn to the edge guide 58 by surface tension. The severing edge 80 is also positioned as close to the bottom of the edge guide 58 as possible to minimize the vertical distance along the edge guide 58 over which the curtain 54 is intercepted. With the catch pan 60 positioned in the intercepting position for stopped coating, a vertical distance of 8 centimeters or less is achievable between the severing edges 80 vertically and the bottom of the respective edge guides. A small distance is favorable because during the retraction of the pan the curtain 54 must reform along the entire edge guide 58 by its release onto the coating receiving surface 52. Preferably, each edge guide 58 comprises parallel dual wires, flushing means (not shown) near the lip 51 of the curtain formation means 50, and suction means (not shown) near the coating receiving surface 52 as disclosed in U.S. Pat. No. 5,328,726 to Reiter and in U.S. Pat. Nos. 5,725,910, 5,763,013, and 5,976,251 to Devine et al. The liquids on the edge guides 58 are removed by the suction means and do not spill onto the coating receiving surface 52. In this manner, all the liquids of the curtain 54 are intercepted without contact between the catch pan 60 and the edge guides 58.

Figure 9:
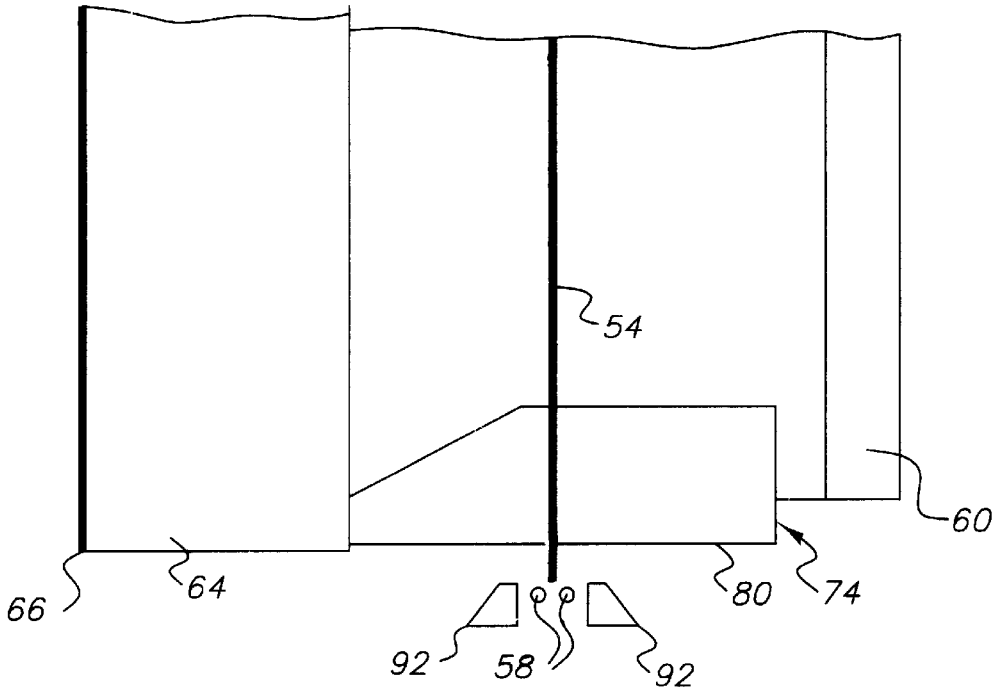
FIG. 9 is a partial top plan view of the catch pan of the present invention in the plane of the curtain shown with the free-falling curtain being intercepted thereby.

To start coating, the pan 60 is retracted at high speed by linear positioning means 90. At the point of curtain release from the horizontal intercepting surface 64, the speed of the catch pan 60 is preferably at least about 100 cm/s. Also, preferably, the releasing edge of the catch pan 60 passes to within a distance of about 2 cm of said coating receiving surface at the point that the free-falling curtain is released to impinge upon the surface of the substrate being coated. High speed prevents the pooling of coating composition on the horizontal intercepting surface 64. Preferably, both the acceleration and deceleration of the pan are controlled. Controlled deceleration is desirable to prevent the mechanical shock caused by a collision with mechanical stops. Servo motors are particularly suited to providing the required motion in a controlled manner. While a single motor may be adequate, catch pans 60 that are a meter or more in width are preferably driven by two synchronized servo motors, one positioned proximate to each side of the pan 60. It should be recognized that more that two servo motors can also be used. Preferably, when using two servo motors, one of the two servo motors is slaved to the other. These motors can be inside the side frames of the coating machine and thereby removed and protected. Because the motors move in step, the catch pan 60 does not skew and contact with the edge guides 58 is obviated. The motors fault if they are out of step, and a collision is thereby prevented. The edge guides 58 may be protected from all sources of mechanical damage by providing protective means 92. The protective means 92 may comprise one or more bumpers running parallel to the edge guide that form cages around the edge guides 58 as shown in FIG. 9.

The use of servo motors to drive motion of the catch pan allows for both smooth acceleration from a complete stop and deceleration to a complete stop. By using linear servo motors, no mechanical components are required to translate rotary motion to linear motion. This minimizes the weight and therefore the inertia of the system. In addition, there is no lost motion or backlash. In tests using linear servo motors in the operation of the system of the present invention, catch pan velocities of 200 cm per second have been achieved. Further, side-to-side alignment of the catch pan has been maintained to within about 1 mm as the catch pan is moved into and out of the intercepting position. Acceleration rates of 4 times gravitational acceleration have been easily attained with controlled stop at the ends of travel thereby preventing equipment damage. An exemplary linear servo motor that can be used in the practice of the present invention is the Kollmorgen Linear Motor Model IL-24-100A3 TR P1, as manufactured by Kollmorgen Motion Technologies Group of Commack, N.Y.

EXAMPLE 2

Using the system of the present invention with linear servo motors to drive a 10 kg catch pan, the catch pan was indexed a distance of 20 cm on an inclination of 30 degrees up from horizontal. The index took 0.140 seconds to complete as follows:

0.0466 seconds of constant acceleration at 4670 cm/second$^2$;

0.0466 seconds at constant velocity at 218 cm/second;

0.0466 seconds of constant deceleration at 4670 cm/second$^2$.

The acceleration took place over a distance of 5 cm. The constant velocity motion took place over a distance of 10 cm. The deceleration took place over a distance of 5 cm.

Those skilled in the art should understand that the use of servo motors allows for non-symmetrical acceleration and velocity profiles in order to optimize performance.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

10 art catch pan
12 primary lip
14 secondary lip
16 pan extension area
18 side walls
20 catch pan
22 flexible extensions
24 flushed edge guides
26 curtain
28 receiving surface
30 catch pan
32 web
34 receiving portion
36 curtain
38 shelf portion
40 upright wall
50 curtain forming apparatus
51 horizontal lip
52 receiving surface
54 curtain
55 web or substrate
56 precision backing roller
57 point
58 edge guides
60 catch pan
62 pan segment
63 sink or drain
64 intercepting surface
66 release edge
68 lip
70 capturing chamber or volume
72 pool
74 side walls
76 vertical wall member
78 inclined wall member
80 horizontal severing edge
90 linear positioning means
92 protective means

What is claimed is:

1. A catch pan apparatus for starting and stopping a curtain coating operation where a free-falling liquid curtain from a curtain forming apparatus is impinged upon a moving substrate to coat the moving substrate, the catch pan apparatus comprising:

(a) an inclined intercepting pan segment from which liquid impinging thereon flows over a first end thereof by gravity to a drain;

(b) a horizontal intercepting member affixed to a second end of the inclined intercepting pan segment, the horizontal intercepting member extending toward the first end to create a capturing chamber between the horizontal intercepting member and the inclined intercepting pan segment, the horizontal intercepting member also extending away from the first end to terminate in a release edge that is parallel to the free-falling curtain; and (c) means for driving the inclined intercepting pan segment into and out of a position of interception of the free-falling curtain before the free-falling curtain impinges on the moving substrate, the capturing chamber preventing any liquid on the inclined intercepting pan segment from flowing therefrom onto the moving substrate when the inclined intercepting pan segment is driven out of the position of interception, the horizontal intercepting member intercepting the free-falling curtain until the release edge thereof passes through the free-falling curtain thereby allowing the free-falling curtain to impinge upon the moving substrate.

2. A catch pan system for starting and stopping a curtain coating operation where a free-falling liquid curtain from a curtain forming apparatus is impinged upon a substrate moving in a first direction to coat the substrate, the catch pan apparatus comprising:

(a) a catch pan, the catch pan including an inclined intercepting pan segment and a horizontal intercepting member, liquid impinging on the inclined intercepting pan segment flowing over a first end thereof by gravity to a drain, the horizontal intercepting member affixed to a second end of the inclined intercepting pan segment, the horizontal intercepting member terminating at a curtain release edge that is parallel to the free-falling curtain and extending toward the first end to create a capturing chamber between the horizontal intercepting member and the inclined intercepting pan segment; and (b) linear positioning means for controllably moving the catch pan to a non-intercepting position, the catch pan travelling substantially in the first direction, and for controllably inserting the catch pan into an intercepting position, the catch pan travelling substantially opposite to the first direction, the capturing chamber preventing any liquid on the inclined intercepting pan segment from flowing therefrom onto the moving substrate when the catch pan is driven out of the intercepting position, the horizontal intercepting member intercepting the free-falling curtain until the release edge thereof passes through the free-falling curtain to the non-intercepting position thereby allowing the free-falling curtain to impinge upon the moving substrate.

3. A catch pan system as recited in claim 2 wherein:

the moving substrate is moving downward at an angle between about 20° and about 60° from horizontal at a point where the free-falling curtain impinges thereon.

4. A catch pan system as recited in claim 2 wherein:

the capturing chamber has a volume of at least 1 cubic centimeter per centimeter of width of the free-falling curtain.

5. A catch pan system as recited in claim 2 wherein:

the linear positioning means drives the catch pan to a speed that is at least about 100 cm/s.

6. A catch pan system as recited in claim 2 wherein:

the releasing edge passes within a distance of not more than about 2 cm of the moving substrate as the releasing edge enters and exits the free-falling curtain.

7. A catch pan system as recited in claim 2 wherein:

the horizontal intercepting member has a lip proximate the releasing edge and extending upwardly therefrom.

8. A catch pan system as recited in claim 2 wherein:

the catch pan also includes sidewalls attached to the inclined intercepting pan segment, each side wall comprising a vertical wall member and an inclined wall member, each inclined wall member extending upward and outward and terminating in a substantially horizontal severing edge having a thickness of less than about 1 mm that is substantially perpendicular to the free-falling curtain, each substantially horizontal severing edge residing at or below an elevation of the horizontal intercepting member.

9. A catch pan system as recited in claim 8 wherein:

each inclined wall member is positioned at an angle in the range of from about 20° to about 45° from horizontal.

10. A catch pan system as recited in claim 9 wherein:

each substantially horizontal severing edge residing within about 1 centimeter of a respective curtain edge guide when the catch pan is in the intercepting position.

11. A catch pan system as recited in claim 10 wherein:

each substantially horizontal severing edge vertically spaced from a bottom of the respective edge guide by not more than about 8 centimeters when the catch pan is in the intercepting position.

12. A catch pan system as recited in claim 8 wherein:

each inclined wall member is positioned at an angle of about 30° from horizontal.

13. A catch pan system as recited in claim 2 wherein:

the linear positioning means includes at least one servo motor.

14. A catch pan system as recited in claim 2 wherein:

the linear positioning means includes two servo motors, one proximate each lateral edge of the catch pan, one of the two servo motors being slaved to the other.

15. A catch pan system as recited in claim 14 wherein:

the at least two servo motors maintain the catch pan in alignment to within about 1 millimeter as the catch pan is moved into and out of the intercepting position.

* * * * *